United States Patent [19]

Otake et al.

[11] Patent Number: 4,476,917

[45] Date of Patent: Oct. 16, 1984

[54] METHOD OF AND SYSTEM FOR CLEANING COOLING TUBES OF HEAT TRANSFER UNITS

[75] Inventors: Katsumoto Otake, Hitachi; Masahiko Miyai, Mito; Takuya Sasaki, Hitachi; Yasuteru Mukai, Hitachi; Sankichi Takahashi, Hitachi; Isao Okouchi, Hitachi, all of Japan

[73] Assignee: Hitachi, Ltd., Tokyo, Japan

[21] Appl. No.: 279,070

[22] Filed: Jun. 30, 1981

[30] Foreign Application Priority Data

Jun. 30, 1980 [JP] Japan ..... 55-89708

[51] Int. Cl.³ ..... F28G 13/00

[52] U.S. Cl. ..... 165/1; 165/95; 432/2

[58] Field of Search ..... 432/2; 122/379; 165/11, 165/95, 1, 104.18, 95

[56] References Cited

U.S. PATENT DOCUMENTS

| | | | |
|---|---|---|---|
| 2,565,689 | 8/1951 | Howse | 122/379 |
| 3,245,460 | 7/1966 | Loebel | 122/379 X |
| 3,633,006 | 1/1972 | Inoue | 165/11 |

FOREIGN PATENT DOCUMENTS

| | | | |
|---|---|---|---|
| 21653 | 2/1979 | Japan | 165/95 |
| 56-80692 | 2/1981 | Japan | 165/95 |
| 721718 | 1/1955 | United Kingdom | 122/379 |

*Primary Examiner*—William R. Cline
*Assistant Examiner*—Theophil W. Streule
*Attorney, Agent, or Firm*—Antonelli, Terry & Wands

[57] ABSTRACT

A method and system for cleaning cooling tubes of a heat transfer unit including a steam chamber through which the cooling tubes extend and into which steam generated in a steam power generating plant is introduced so as to exchange heat with a cooling water flowing through the cooling tubes. Cleaning bodies are introduced into the cooling water and then distributed to the cooling tubes so as to clean the latter. The cooling tubes are divided into a plurality of groups, with each group including a plurality of the cooling tubes having the same trends of cleanliness. The cleaning bodies are respectively introduced to the groups in respective quantities suitable for cleaning the cooling tubes of each group in dependence upon the particular degree of cleanliness of the cooling tubes of the respective groups.

10 Claims, 9 Drawing Figures

METHOD OF AND SYSTEM FOR CLEANING COOLING TUBES OF HEAT TRANSFER UNITS

BACKGROUND OF THE INVENTION

The present invention relates to a method of cleaning a plurality of cooling pipes in a heat transfer unit in a steam power generating plant and, more particularly, to a method of cleaning the cooling pipes by circulating a number of cleaning bodies, such as sponge balls, through the cooling tubes.

The invention is also concerned with a cleaning system suitable for carrying out the cleaning method.

Generally, a steam power generating plant has a condenser incorporating a plurality of cooling tubes which open at their one ends to a cooling water inlet chamber and at their other ends to a cooling water outlet chamber defined in the condenser. A cooling water inlet pipe and a cooling water outlet pipe are connected to the cooling water inlet chamber and the cooling water outlet chamber of the condenser, respectively. The cooling water is supplied by a cooling water supply pump into the cooling water inlet chamber of the condenser through the cooling water inlet pipe, and is distributed over all cooling tubes to flow therethrough to reach the cooling water outlet chamber from which it is discharged through the cooling water outlet pipe.

In a steam power generating plant of ordinary electric power station or nuclear power station, sea water is usually used as the cooling water for the condenser. The sea water generally contains various foreign matters such as slime, marine animals and so forth. Consequently, these foreign matters attach to the inner surfaces of the cooling tubes to contaminate the latter, resulting in a lowered heat transfer across the walls of the cooling tubes. As a result, the heat exchanging performance of the condenser is deteriorated to lower the level of the vacuum established at the steam side of the condenser, which, in turn, undesirably elevates the back pressure of the power generating tubrine to lower the power generating efficiency of the plant as a whole. To avoid this, the cleaning of the inner surfaces of cooling tubes is essential.

The cleaning of the cooling tubes is achieved by circulating a number of cleaning bodies, such as sponge balls, through the cooling tubes together with cooling water.

In the conventional cooling tube cleaning system, the cleaning bodies are charged into the cooling water inlet pipe of the condenser and moved to the cooling water inlet chamber from which they pass through the cooling tubes to reach the cooling water outlet chamber and are then discharged from the condenser through the cooling water outlet pipe. The cleaning bodies are finally collected in the cooling water discharge pipe.

There has been no attempt made to quantitatively grasp the contamination of the cooling tubes in the condenser. Namely, in the conventional method, various data such as level of vacuum in the condenser, inlet temperature of the cooling water, outlet temperature of the cooling water, delivery pressure of the cooling water supply pump and so forth are observed independently. The cleaning is carried out when there is any sign of cooling tube contamination, such as lowering of the condenser vacuum, reduction of the temperature difference of cooling water at the inlet and outlet sides, rise of the pump delivery pressure and so on. When the sea water is used as the cooling water, the amount and type of the contaminants such as slime and marine animals differ depending on the season. Some of the contaminants may accumulate drastically in the cooling tubes to cause a rapid contamination.

It is, therefore, impossible to achieve an effective cleaning of cooling pipes, with the conventional system in which the contamination of the cooling tubes is qualitatively judged through observation of independent data. Consequently, the efficiency of the power generating plant has been undesirably lowered due to an inadequate management of the cleaning of the cooling tubes.

For maintaining the condenser in clean state as much as possible, it has been a common measure to conduct the cleaning in accordance with an annual cleaning schedule or plan which is worked out beforehand taking into consideration the seasonal change in the amount and types of contaminants brought into the condenser. In other words, the frequency or demand for the cleaning work varies according to the season. This qualitative determination of the contamination, i.e. the qualitative mangagement of the cleanliness, cannot provide effective and satisfactory cleaning of the cooling tubes. In order to maintain a constant performance of the steam power generating plant, it is highly desirable to exactly ascertain the cleanliness of the cooling tubes and to carry out the cleaning whenever it becomes necessary, i.e. when the cleanliness goes below a predetermined limit of allowance.

U.S. patent application Ser. No. 213,095, filed on Dec. 4, 1980, now U.S. Pat. No. 4,390,058, proposes an improved tube cleaning method wherein the heat flux across the tube wall is measured by heat flux sensors attached to some of the cooling tubes, while the temperature difference of cooling water between the inlet and outlet sides of the condenser is measured by means of temperature sensors provided in the cooling water inlet pipe and the cooling water outlet pipe, respectively. Then, the total heat transfer coefficient is calculated from the measured data to provide an index of the actual cleanliness of the cooling tubes, to inform the operator of the change or timing for the cleaning of the tubes. This method satisfies to some extent the demand for adequate cleaning of the cooling tubes. This method, however, is still unsatisfactory, although it permits a qualitative determining of the tube cleanliness and selection of timing for the effective cleaning, due to the reason stated below.

Namely, all of the plurality of cooling tubes in a condenser do not always have equal degree of contamination. The cleaning bodies such as sponge balls are once introduced into the cooling water inlet chamber and then distributed to the plurality of cooling tubes. This means that some of the cooling tubes can receive sufficient number of cooling bodies while the others can not, mainly due to the influence of state of flow of water. Thus, it is impossible to clean all cooling tubes equally, with the conventional cleaning method which treates all cooling tubes as a group.

For cleaning all cooling tubes equally and satisfactorily, it is necessary to determine the state of contamination locally and quantitatively and to effect the cleaning with a suitable weight of cleaning power on each local point of contamination.

SUMMARY OF THE INVENTION

Accordingly, an object of the invention is to provide a method of cleaning cooling tubes which permits, upon locally determining the state of contamination of the cooling tubes, an effective cleaning for each local area of tube nest depending on the degree of the contamination.

Another object of the invention is to provide a cleaning system suitable for carrying out the cleaning method.

The invention will be more fully understood from the following description of the preferred embodiments taken in conjunction with the accompanying drawings.

DESCRIPTION OF THE PREFERRED EMBODIMENTS

Figure 1:
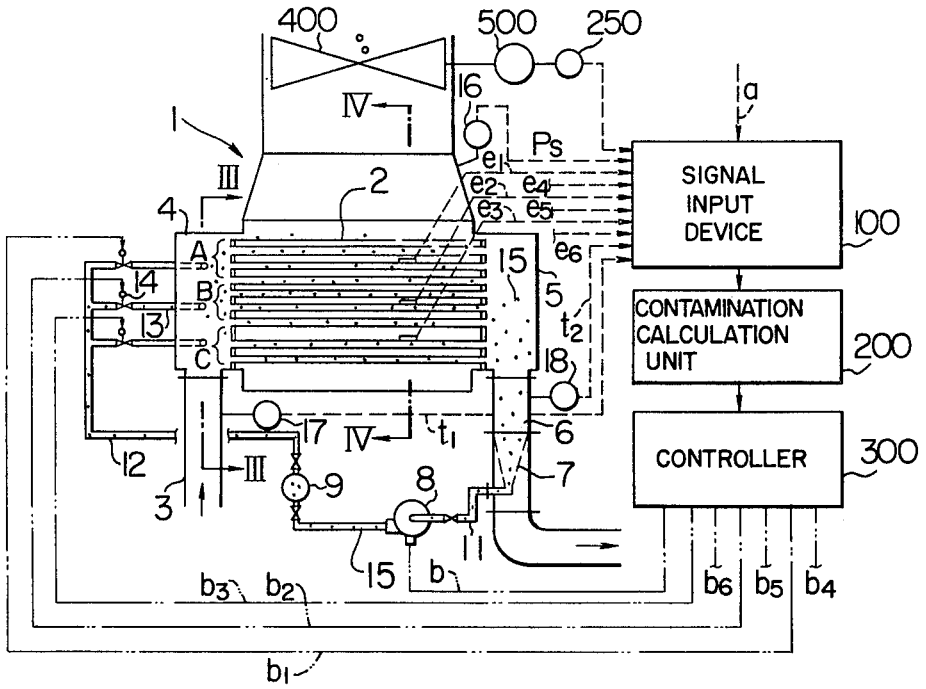
FIG. 1 is a schematic illustration of a cleaning system for cleaning the cooling tubes of a condenser, constructed in accordance with an embodiment of the invention.

Referring first to FIG. 1, a steam power generating plant has a condenser generally designated by the reference numeral 1 incorporating a plurality of cooling tubes or pipes 2. Cooling water is supplied into the cooling tubes 2 from a cooling water inlet pipe 3 through a cooling water inlet chamber 4 of the condenser 1. The cooling water is then collected at a cooling water outlet chamber 5 of the condenser 1 and is discharged through a cooling water outlet pipe 7. A cooling water inlet temperature sensor 17, a cooling water outlet temperature sensor 18, and a sensor for detecting the steam pressure 16 in the condenser 1 are provided. The arrangement is such that the cooling tubes 2 are cleaned by cleaning bodies 15, such as sponge balls, circulated therethrough. The cleaning system includes a cleaning body circulating pump 8, a cleaning body collector 9 communicated with the delivery port of the pump 8, and a plurality of cleaning body nozzles 13 which communicates with the collector 9 through a conduit 12 and opens into the cooling water inlet chamber 4 of the condenser 1. The cleaning system further has a cleaning body arrester 7 disposed in the cooling water outlet pipe 6. The arrester 7 is communicated through a conduit 11 with the suction port of the cleaning body circulating pump 8.

The cleaning bodies 15 supplied from the cleaning body circulating pump 8 are charged into the cooling water inlet pipe 3 and are moved into the cooling water inlet chamber 4 together with the cooling water. The cooling bodies together with the cooling water are distributed to a plurality of cooling tubes 2 to flow therethrough to reach the cooling water outlet pipe 6 through the cooling water outlet chamber 5. The cooling bodies are then arrested by the arrester 7 in the pipe 6, and are returned to the cleaning body circulating pump 8.

As a matter of fact, the cleaning bodies 15 are not uniformly distributed over the entire cooling tubes, due to the influence of the state of flow of cooling water. For instance, cooling tubes 2 disposed at the upper and lower parts of FIG. 1 can receive only small quantity of cleaning bodies, while the cooling tubes 2 located near the center of the cross-section of the condenser can receive a large quantity of the cooling bodies 15. Consequently, the cooling tubes 2 in the upper and lower regions cannot be cleaned sufficiently, while the cooling tubes 2 in the central area can be cleaned satisfactorily.

Figure 5:
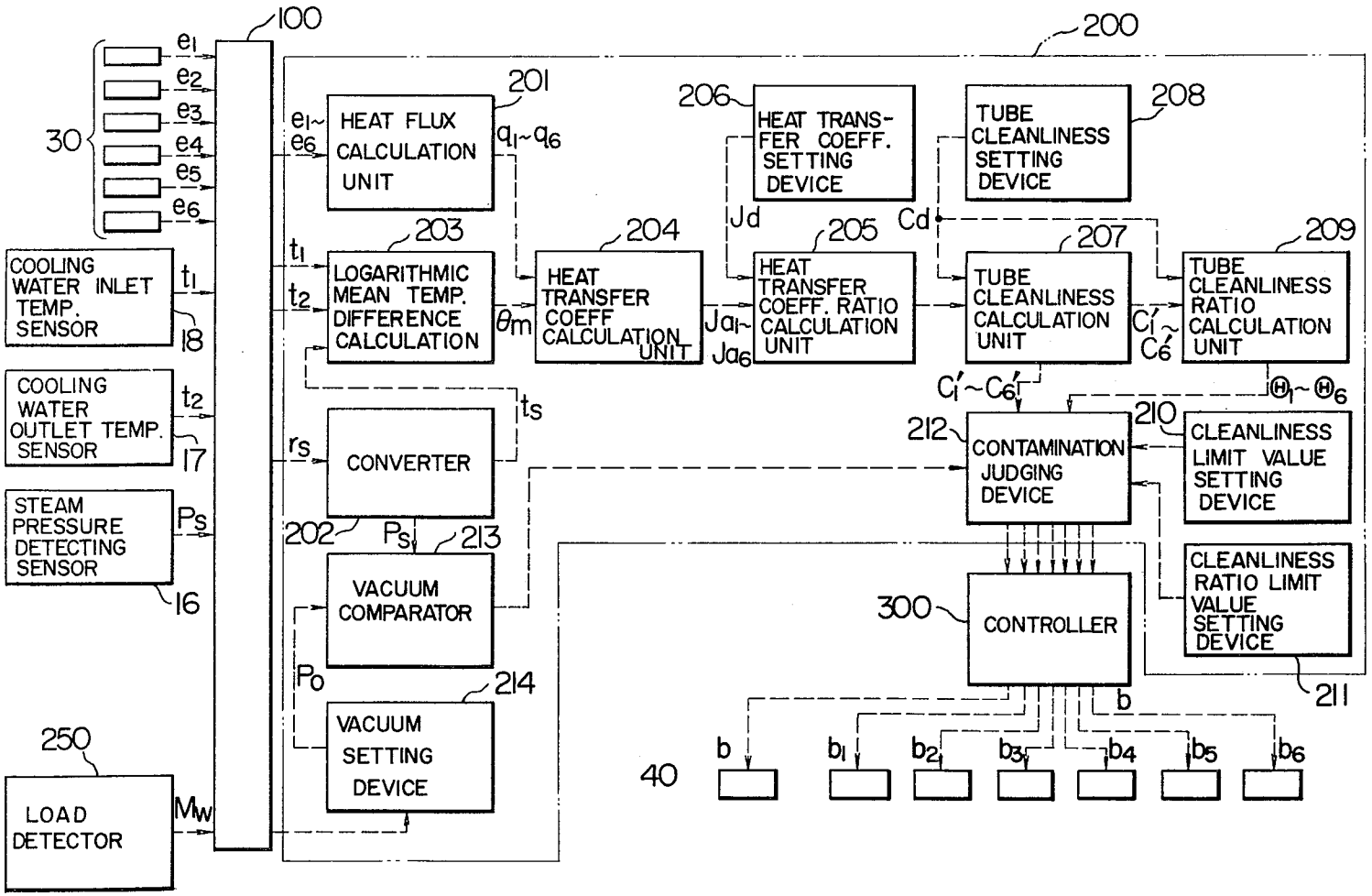
FIG. 5 is a block diagram of a mounting system shown in FIG. 2.

In the illustrated embodiment, a generator 500 is driven by the turbine 400 shown in FIG. 1 to produce electric power, with the heat transfer unit befing formed by the condenser 1 for liquefying the steam which is the working fluid acting in the turbine 400 and with the generator 500 being provided with a load detector 250 adapted to generate a signal MW (FIG. 5). As shown in will be clearly understood FIG. 2, the tube nest consisting of the plurality of cooling tubes 2 is divided into two groups, i.e. a left and a right groups symmetrical with each other, and each group is further divided into sub-groups, i.e. an upper sub-group, middle sub-group and a lower sub-group. Thus, there are six sub-groups, A, B, C, D, E and F with six cleaning body nozzles 13 opening into the cooling water inlet chamber 4 so as to oppose to corresponding sub-groups of the cooling tubes 2. Each of the cleaning body nozzles 13 is provided with a valve 14 for controlling the rate of supply of the cleaning bodies 15. Cleaning bodies 15 are supplied to each valve 14 from the cleaning body circulating pump 8 and collector 9 through branch passages 12*a*, 12*b* branching from the conduit 12.

Figure 2:
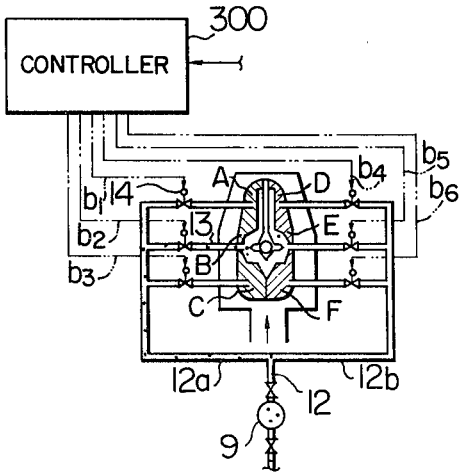
FIG. 2 is a cross-sectional view taken along the line II—II of FIG. 1.

FIG. 2 shows the combination of the cleaning body nozzle 13 and the valve 14 arranged for each of the sub-groups A to F of the cooling tubes 2.

Figure 4:
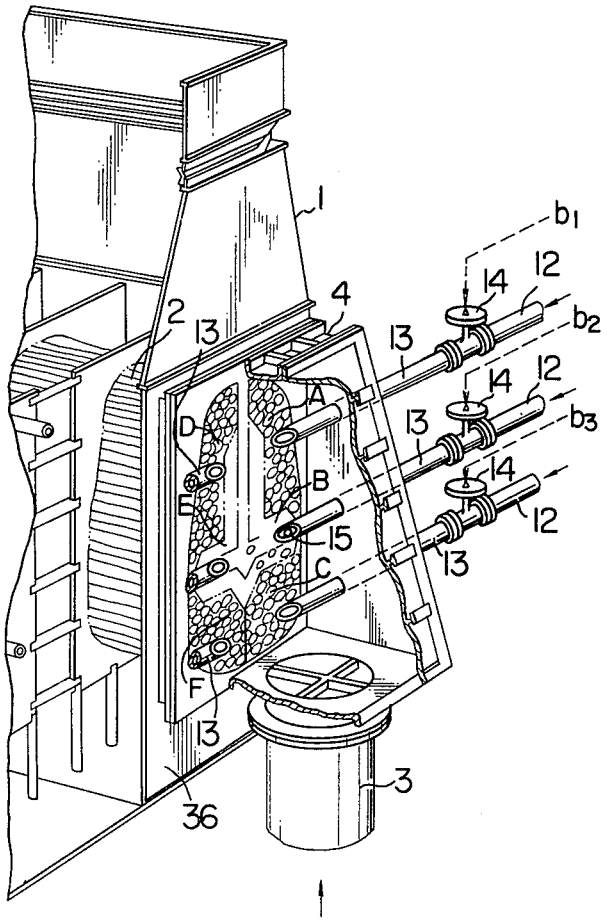
FIG. 4 is a perspective view of the portion shown in FIG. 3.

As shown in FIGS. 1 and 4, control signal lines $b_1$, $b_2$, $b_3$, $b_4$, $b_5$ and $b_6$ connected to respective valves 14 provides control signals so that the rates of supply of the cleaning bodies 15 by respective valves 14 vary in accordance with an opening degree of the valves 14.

Figure 3:
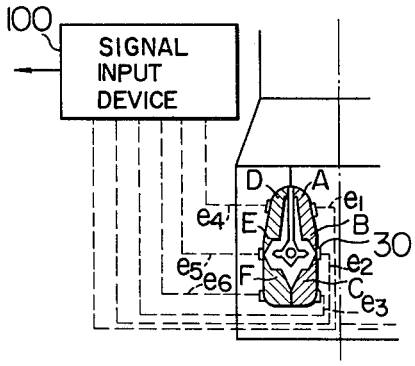
FIG. 3 is a cross-sectional view taken along the line III—III of FIG. 1.

As shown in FIG. 3, a heat flux sensor 30 is attached to representative cooling tubes 2 in each sub-group. Needless to say, a plurality of heat flux sensors 30 may be attached to a representative cooling tubes 2 to increase the accuracy of the measurement of heat flux, with the heat flux sensors 30 being related to the sub-groups of the cooling tubes 30.

As shown in FIG. 5, signals from various sensors or detectors such as output signals $e_1$, $e_2$, $e_3$, $e_4$, $e_5$, $e_6$ from the heat flux sensors 30, output $P_s$ from the condenser vacuum sensor, cooling water inlet and outlet temperature signals $t_1$, $t_2$ from respective temperature sensors and the load signal MW from the load detector 250 are delivered to a signal input device 100 which receives also a signal a (FIG. 8) representing the planned condition such as planned overall heat transfer coefficient, planned tube cleanliness and so forth.

A contamination calculation unit 200 makes an operation using the date inputted to the input device 100, to calculate the cleanliness of cooling tubes 2 in each sub-group A–F and a mean tube cleanliness, and the cleanlinesses of all sub-groups A–F are compared with one another. The result of the operation is transmitted to a controller 300 which is adapted to issue the control signals.

Namely, the degrees of contamination of cooling tubes 2 in respective sub-groups A–F are sensed as the output signals $e_1$ to $e_6$ from the heat flux sensors 30 and, upon receipt of signals $e_1$–$e_6$, the controller 300 issues control signals b, $b_1$ to $b_6$ to operate the cleaning body circulating pump 8 and the valves 14 to clean the cooling tubes 2 to recover the necessary vacuum level in the condenser 1. As explained before, the cooling tubes of sub-groups A to F do not exhibit uniform contamination but rather show different degrees of contamination, with the difference being sensed by the heat flux sensors 30 attached to the representative cooling tube 2 of respective sub-groups A–F. These sensors 30 transmit the outputs $e_1$ to $e_6$ to the contamination calculation unit 200 where these signals are compared, the result of which is transmitted to the controller 300. Thus, the controller 300 in some cases issues the operation instructions only to the valves 14 belonging to the sub-groups A–F in which the contamination is serious.

It is possible to make the contamination calculation unit 200 memorize the relationship between the cleaning time length and the rate of recovery of cleanliness. In such a case, the controller 300 keeps the duration of the control signals $b_1$ to $b_6$ for time lengths corresponding to the degrees of contamination in respective sub-groups A–F, so that the time lengths of an opening of respective valves 14 are suitably controlled in accordance with the degrees of contamination.

Figure 6:
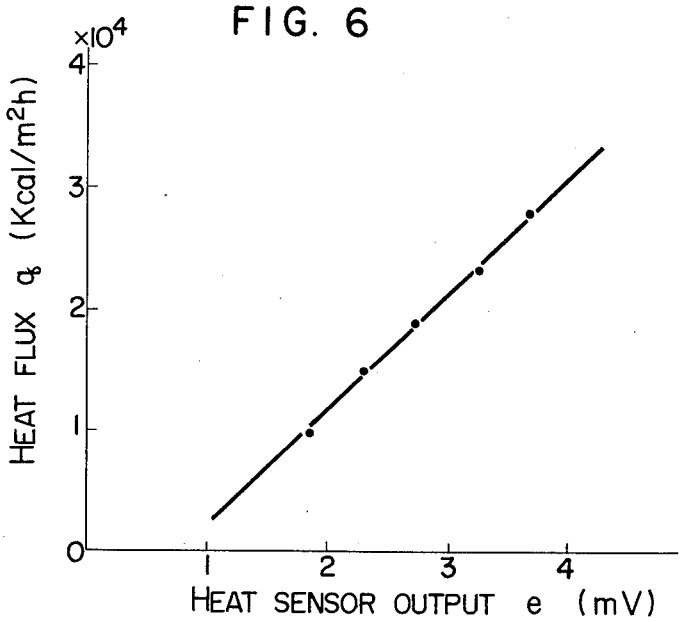
FIG. 6 is a block diagram showing the relationship between the output from a heat flux sensor and the heat flux across the wall of a cooling tube.

More specifically, referring to FIG. 6, the output signals $e_1$ to $e_6$ from the heat flux sensors 30 attached to representative one of respective sub-groups A to F of cooling tubes 2 take the form of a voltage mV. As shown in FIG. 6, it has been confirmed through actual measurement that there is a linear relationship between the heat fluxes $q_1$ to $q_6$ across the tube walls and the levels of output from respective heat flux sensors 30. This relationship is inputted as an input data to a heat flux calculation unit 201 to permit the latter to calculate the actual heat fluxes $q_1$ to $q_6$, in accordance with the following equation (1) (Refer to FIG. 5).

$$q_i \alpha k \cdot e_i (i=1\sim6) \tag{1}$$

where, K represents a coefficient.

It is thus possible to easily measure the heat fluxes across the tube walls of the cooling tubes 2, by the operation of the heat flux sensors 30.

Meanwhile, the steam pressure or vacuum Ps is converted by a converter 202 into corresponding saturation temperature $t_s$. On the other hand, a vacuum comparator 213 makes a comparison between a command vacuum signal $P_o$ delivered by a vacuum setting device 214 and the measured steam pressure Ps. In case where the measured steam pressure Ps is lower than the command vacuum, this fact is inputted to a contamination judging device 212.

The measured logarithmic mean temperature difference $\theta m$ is calculated from the output $t_1$ of the cooling water inlet temperature sensor 17 and the output $t_2$ of the cooling outlet temperature sensor 18, in accordance with the following equation (2). This calculation is made employing the saturation temperature $t_s$ which is the output from the converter 202. Namely, the output signals $t_1$, $t_2$, $t_s$ are delivered to a logarithmic mean temperature difference calculation unit 303 which performs the following arithmetic operation.

$$\theta m = \frac{t_2 - t_1}{\ln \frac{t_s - t_1}{t_s - t_2}} \tag{2}$$

In this calculation, the steam temperature $t_s$ may be directly derived from a temperature sensor attached to the condenser 1.

An overall heat transfer coefficient calculation unit 204 calculates the measured overall heat transfer coefficient Ja, from the heat fluxes $q_1$ to $q_6$ calculated by the heat flux calculation unit 201 and the logarithmic mean temperature difference $\theta m$ calculated by the logarithmic mean temperature difference calculation unit 203, in accordance with the following equation (3).

$$Ja_i = q_i / \theta m (i=1\sim6) \tag{3}$$

Subsequently, using the design heat transfer coefficient Jd previously set by heat transfer coefficient setting device 206, the ratio R of heat transfer coefficient is calculated by heat transfer coefficient ratio calculation unit 205. The design heat transfer coefficient is calculated from a predetermined operating condition of the plant such as load level, flow rate of cooling water, cooling water inlet temperature and so forth, taking into account the specifications of the condenser 1.

The calculation of the ratio of the heat transfer coefficient is cotducted in accordance with the following equation (4).

$$Ri = Ja_i / Jd (i=1\sim6) \tag{4}$$

In this equation, the heat transfer coefficient Jd represents the value before the contamination of the tube 2. Therefore, the ratio R inevitably takes a value smaller than 1, i.e. $|R|<1$, whenever there is a deterioration of the performance due to the tube contamination.

Then, the cleanliness C′ of the cooling tubes in the operating condition of the plant is calculated in accordance with the following equation (5), using the heat transfer coefficient ratio R derived from equation (4) and the design tube cleanliness Cd, by means of a tube cleanliness calculation unit 207.

$$C'_i = Cd \cdot R_i (i=1\sim6) \tag{5}$$

Furthermore, a cleanliness ratio H is calculated by a tube cleanliness ratio calculation unit 209 in accordance with the following equation (6), using the calculated cleanliness C′ and a design cleanliness Cd which is set by a design cleanliness setting device 208.

$$\theta_i = \frac{Cd - C'_i}{Cd} \times 100 \ (i = 1\sim6) \tag{6}$$

As a result of a series of arithmetic operation mentioned above, the cleanliness $C'_1$ to $C'_6$ and the tube cleanliness ratio $\theta_1$ to $\theta_6$ are calculated for respective sub-groups A–F of the cooling tubes 2. That is, the degrees of contamination of cooling tubes 2 in respective sub-groups A–F are quantitatively determined.

As has been described above, only one heat flux sensor 30 is attached to the representative cooling tube in each sub-group A–F. However, this arrangement is not exclusive and the cleanliness will be measured at higher accuracy when a mean overall heat transfer coefficient is obtained for each representative tube 2 using a plurality of heat flux sensors 30 attached to each representative tube 2. The aforementioned contamination judging device 212 functions to compare the cleanliness $C'_1$ to $C'_6$ and cleanliness ratios $\theta_1$ to $\theta_6$ calculated for respective sub-groups A to F of the cooling tubes with the limit values Co, $\theta$o which are set, respectively, by a cleanliness limit value setting device 210 and a cleanliness ratio limit value setting device 211.

In the event that any one or more sub-groups A to F exhibit a cleanliness C' or cleanliness ratio $\theta$ falling below the limit value Co or $\theta$o, an operation instruction is given without delay to the cleaning body circulating pump 8 of the cleaning system to drive the latter thereby to circulate the cleaning bodies 15 through the cooling tubes 2.

Namely, upon receipt of a cleanliness abnormal signal from the contamination judging device 212 and the vacuum abnormal signal from the vacuum comparator 213, the controller 300 sends the control signal b to actuate the pump driving device 40 to thereby start the cleaning body circulation pump 8. The preparation for the cleaning work is now completed.

Then, the controller delivers the valve opening signals $f_1$ to $f_6$ corresponding to the cleanliness $C'_1$ to $C'_6$ and the cleanliness ratios $\theta_1$ to $\theta_6$ to the valve opening adjusters 50 associated with respective valves 14, so that the valves 14 are opened to degrees corresponding to the degree of contamination of the cooling tubes 2 in the corresponding sub-groups A to F. Consequently, each sub-group A–F of the cooling tubes 2 is allowed to receive the cooling bodies 15 at a rate which well meets the degree of contamination of the cooling tubes 2 in the sub-group A–F. In other words, it is possible to impart different cleaning powers to different sub-groups A to F of the cooling tubes 2, to carry out effective cleaning on the local areas in which the contamination is heavy.

Since the contamination calculation unit 200 continuously calculates the cleanlinesses $C'_1$ to $C'_6$ and the cleanliness ratio $\theta_1$ to $\theta_6$ to permit a successive adjustment of the opening degrees of the valves 14, it is possible to achieve an effective cleaning following up the state of contamination.

Figure 7:
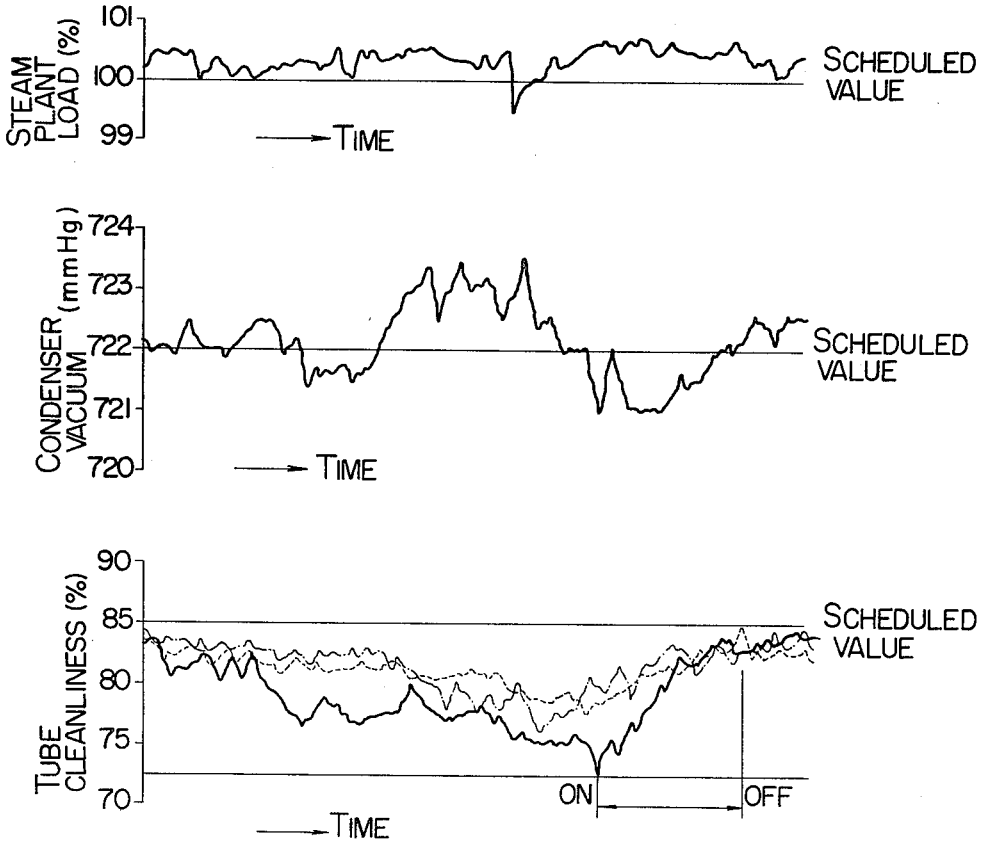
FIG. 7 is a graph showing the relationship existing among the cleanliness of the cooling tubes, condenser vacuum and the level of load in a steam power generating plant.

The operation explained hereinbefore will be more fully understood from the following description taken in conjunction with FIG. 7. Assume here that the cleanlinesses $C'_3$ and $C'_6$ of the sub-groups C and F out of six groups A to F have come down below the limit value Co. In such a case, the valves 14 belonging to the sub-groups C and F are opened to degrees somewhat greater than those of the valves 14 belonging to other groups A, B, D, E, so that the cleaning bodies 15 are circulated in the cooling tubes 2 of the sub-groups C and F at a rate greater than that in other sub-groups A, B, D, E. The pump driving device 40 is started at the moment at which the cleanlinesses $C'_3$ and $C'_6$ of the sub-groups C and F come down below the limit value Co, to start the cleaning body circulation pump 8. The calculation of contamination is continued even during the execution of the cleaning operation, so that the opening degrees of the valves 14 are successively changed to optimize the rates of supply of the circulation bodies 15 to respective sub-groups A–F of the cooling tubes 2.

Then, as the design cleanliness is substantially recovered in the sub-groups C and F as a result of the cleaning, the controller 300 stops the supply of the control signal b to the pump driving device 40, so that the latter acts to stop the cleaning body circulating pump 8.

For maintaining a high efficiency of the power plant, it is desirable to optimize the steam pressure Ps in the condenser in accordance with the change of the load MW imposed on the turbine generator 500. To this end, a load detector 250 detects the load MW on the generator and delivers the signal to the vacuum setting device 214 to optimize the set value Po of the condenser vacuum. Namely, in the event that the load MW on the generator is increased, the vacuum setting device 214 acts to shift the set value Po in the vacuum setting device 214 to the higher side, whereas, when the load is decreased, the set value Po of the vacuum to the lower side.

Figure 8:
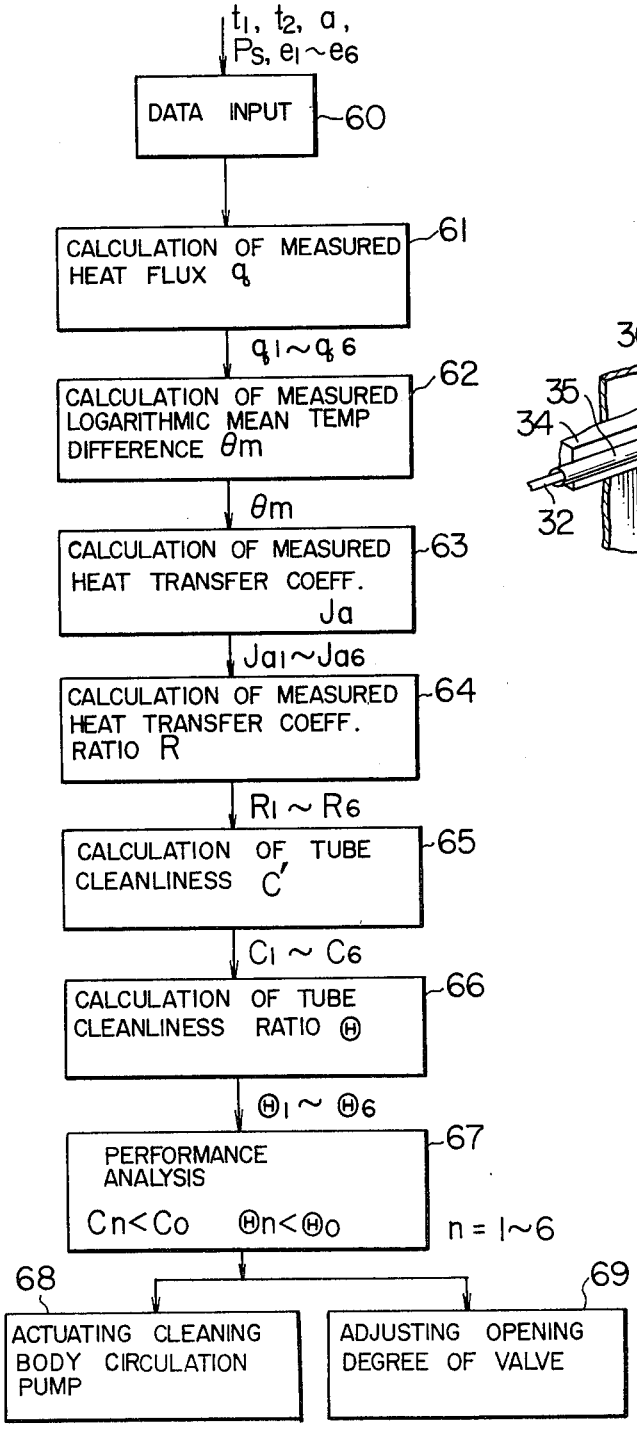
FIG. 8 is a flow chart showing the operation of the mounting system shown in FIG. 6.

The operation of the contamination calculation unit 300 will be more fully understood when the foregoing description is read in conjunction with FIG. 8 showing the flow chart of the operation.

From FIG. 7, it will be seen that the sub-groups A and D exhibit the same tendency of change of cleanliness. The same applies also to the sub-groups B and E, as well as to the sub-groups C and F. This is attributable to the fact that the sub-groups A to C and the sub-groups D to F are arranged in symmetry, as will be understood from FIGS. 2 and 4. This effect cannot be expected when the cooling water inlet pipe 3 is bent in the area near the cooling water inlet chamber 4, because an asymmetric flow of cooling water is created in the inlet chamber 4, even if the sub-groups A to C and the sub-groups D to F are arranged in symmetry. This, however, does not matter in the cleaning method and system of the invention because the invention is based upon the detection and management of the contamination in independent sub-groups A to F.

Figure 9:
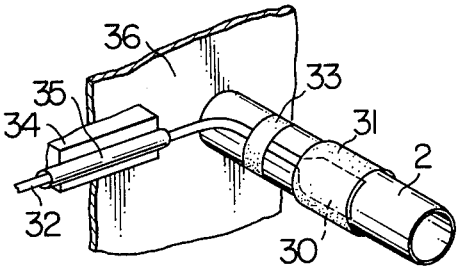
FIG. 9 is a perspective view showing how the heat flux sensor is mounted.

FIG. 9 shows the detail of the structure for mounting the heat flux sensor 30 on the cooling tube 2. More particularly, the heat flux sensor 30 is attached to an outer surface of the cooling tube 2 by means of a band 31. The leads 32 are extended along the cooling tube 2 through reinforcement bands 33 and then along a tube plate 36 by means of an attaching plate 34 and a protective tube 35.

As has been described, according to the invention, there is provided a cleaning method and system in which the plurality of cooling tubes 2 in a condenser 1 is divided into a plurality of groups A–F and at least one heat flux sensor 30 is attached to the outer surface of a representative cooling tube 2 in each group A–F. These heat flux sensors 30 sense the heat fluxes in respective groups A–F, while the steam pressure or vacuum in the condenser 1 and the cooling water temperatures at the inlet and outlet sides of the condenser 1 is measured by respective sensors. The measured data are used for for calculating the cleanliness and cleanliness ratios in the cooling tubes 2 in respective groups A–F.

Consequently, the present invention offers the following advantages.

(1) It is possible to locally determine the state of contamination of a plurality of cooling tubes 2.

(2) It is possible to manage the cleaning operation for each of local area of contamination in accordance with the degree of contamination of these areas.

(3) It is possible to maintain all cooling tubes 2 in the clean state, so that the condenser 1 can operate always at a satisfactorily high performance.

Although the invention has been described through specific terms, the described embodiments are not exclusive and various changes and modifications may be imparted thereto without departing from the spirit or scope of the invention which is limited solely by the appended claims. For instance, the invention is applicable to other heat exchangers having cooling tubes 2 other than the condenser 1.

What we claim is:

1. In a method of cleaning cooling tubes of a heat transfer unit having a steam chamber through which said cooling tubes extend and into which steam generated in a steam power generating plant is introduced under a steam pressure so as to exchange heat with a cooling water flowing through said cooling pipes, an inlet means for distributing the cooling water having an inlet temperature to one end of said cooling tubes and an outlet means for collecting the cooling water having an outlet temperature from the other end of said cooling tubes, the method comprising the steps of measuring heat flux which is transferred through walls of said tubes at selected ones of said cooling tubes, obtaining data of said steam pressure, said inlet temperature and said outlet temperature, finding a cleanliness of said cooling tubes by calculating said data, introducing cleaning bodies into the cooling water through said inlet means so as to distribute the cleaning bodies to the cooling tubes to clean the latter, and collecting the cleaning bodies from the cooling water through said outlet means, the improvement comprising dividing said cooling tubes into a plurality of groups, each of said groups including a plurality of said cooling tubes having the same trends of cleanliness, said step of selecting include selecting one cooling tube from each of said groups and said step of introducing includes respectively introducing said cooling bodies into the cooling tubes of said groups with respective quantities of the cleaning bodies being suitable for cleaning the cooling tubes of each of said groups in dependence upon a particular degree of cleanliness of said cooling tubes of each of said groups, whereby larger quantities of said cleaning bodies are selectively fed to said groups of cooling tubes having a relatively low cleanliness.

2. A method as set forth in claim 1, wherein said cleanliness is continuously monitored and the data is continuously calculated, and said respective quantities of said cleaning bodies are continuously adjusted in accordance with the monitored cleanliness.

3. In a cleaning system for cooling tubes of a heat transfer unit having a steam chamber through which said cooling tubes extend and into which steam generated in a steam power generating plant is introduced under a steam pressure so as to exchange heat with a cooling water flowing through said cooling tubes, an inlet means for distributing the cooling water having an inlet temperature to one end of said cooling tubes and an outlet means for collecting the cooling water having an outlet temperature from the other end of said cooling tubes, said cleaning system comprising: means for detecting heat flux transferred through walls of selected ones of said cooling tubes, means for detecting said inlet temperature, means for detecting a condition of the steam, means for finding a cleanliness of said cooling tubes by calculating the data of said inlet temperature, said outlet temperature and said steam condition, means for introducing cleaning bodies into the cooling water through said inlet means so as to distribute said cleaning bodies to the cooling tubes to clean the latter, and means for collecting said cleaning bodies from the cooling water through said outlet means, the improvement wherein said cooling tubes are divided into a plurality of groups, each of said groups including a plurality of said cooling tubes having the same trends of cleanliness, said heat flux detecting means is arranged to detect the heat flux at each of the selected cooling tubes of said groups, and said cleaning body introducing means is adapted to distribute the cleaning bodies to at least one of said groups with respective quantities suitable for cleaning the cooling tubes of each of said groups in dependence upon a particular degree of cleanliness of said cooling tubes of each of said groups in accordance with the heat flux detected by said detecting means whereby larger quantities of cleaning bodies are selectively fed to at least one of said groups of cooling tubes having a relatively low cleanliness.

4. A system as set forth in claim 3, wherein said cleaning body introducing means comprises a plurality of nozzles, each of said nozzles including a control valve connected thereto through a passage for adjusting the quantity of said cleaning bodies fed into the cooling water, each of said nozzles being opened to said one end of said cooling tubes of each of said groups.

5. A system as set forth in claim 4, wherein said heat flux detecting means includes a plurality of heat flux sensors, each of said sensors being attached to a tube wall of the selected one of said cooling tubes of each of said groups.

6. In a cleaning system for cooling tubes of a heat transfer unit having a steam chamber through which said cooling tubes extend and into which steam generated in a steam powered generating plant is introduced under a steam pressure so as to exchange heat with a cooling water flowing through said cooling tubes, an inlet means for distributing the cooling water having an inlet temperature to one end of said cooling tubes and an outlet means for collecting the cooling water having an outlet temperature from the other end of said cooling tubes, said cleaning system comprising: means for detecting heat flux transferred through walls of selected ones of said cooling tubes, means for detecting said inlet temperature, means for detecting a condition of the steam pressure, means for finding a cleanliness of said cooling tubes by calculating the data of said inlet temperature, said outlet temperature and said steam pressure, means for introducing the cleaning bodies into the cooling water through said inlet means so as to distribute the cleaning bodies to the cooling tubes to clean the latter, and means for collecting said cleaning bodies from the cooling water through said outlet means, the improvement wherein said cooling tubes are divided into a plurality of groups each including a plurality of said cooling tubes having the same trends of cleanliness, said heat flux detecting means is arranged to detect the heat flux at each of the selected cooling tubes of each group, and said cleaning body introducing means is arranged to distribute the cleaning bodies to said groups with respective amounts suitable for cleaning the cooling tubes of each of said groups in depdendence upon the cleanliness of said cooling tubes of each of said groups, the cleaning body introducing means comprises a plurality of nozzles each provided with a control valve having a control unit for adjusting said amount of said cleaning bodies fed into the cooling water, each of said nozzles being opened to said one end of said cooling tubes of each of said groups, said heat flux detecting means includes a plurality of heat flow sensors attached to the tube wall of said selected one of said cooling tubes of each of said groups, and a calculator for calculating a mean value of the heat fluxes detected at said selected one of said cooling tubes of each of said groups through said heat flow sensors.

7. A system as set forth in claim 5 or 6, wherein said heat transfer unit is a condenser.

8. A system as set forth in claim 4, wherein said control unit is fed with a control signal from said finding means so as to control said associated control valve.

9. A system as set forth in claim 3, wherein said means for detecting a steam condition is adapted to detect a temperature of said steam in said steam chamber.

10. A system as set forth in claim 7, wherein said condenser receives said steam discharged from a turbine for driving a generator, and said system further comprises means for detecting a load value from said generator, said load value being used as one of said data in determining cleanliness of said cooling tubes.

* * * * *